US005857331A

United States Patent [19]

Christensen et al.

[11] Patent Number: 5,857,331

[45] Date of Patent: Jan. 12, 1999

[54] HYDRAULIC SYSTEM

[75] Inventors: Carsten Christensen, Broager; Carl Christian Dixen, Sydals, both of Denmark

[73] Assignee: Danfoss A/S, Nordborg, Denmark

[21] Appl. No.: 933,438

[22] Filed: Sep. 18, 1997

[30] Foreign Application Priority Data

Sep. 28, 1996 [DE] Germany ..... 196 40 100.3

[51] Int. Cl.[6] ..... F15B 11/16

[52] U.S. Cl. ..... 60/452; 60/422; 91/433; 91/441; 91/444

[58] Field of Search ..... 91/444, 433, 441; 60/452, 422

[56] References Cited

U.S. PATENT DOCUMENTS 5,083,430 1/1992 Hirata et al. ..... 91/444

5,323,687 6/1994 Zenker et al. ..... 91/449

5,642,616 7/1997 Park ..... 60/452

*Primary Examiner*—Sheldon S. Richter

*Attorney, Agent, or Firm*—Lee, Mann, Smith, McWilliams, Sweeney & Ohlson

[57] ABSTRACT

A hydraulic system with a pressure source controllable via a load sensing signal, a pressure sink, at least two working sections, each having a hydraulic consumer and a control valve with a load sensing signal connection and at least one back-pressure valve arranged in a tank pipe between the control valve and the pressure sink. In such a system the pressure required from the pump in the neutral position must be as low as possible. On the other hand, however, oscillations should not occur, when an external force acts on another hydraulic consumer in the neutral position of a control valve. In the neutral position of the control valves the load sensing signal connection is therefore connected with the pressure sink via an auxiliary tank pipe by-passing the back-pressure valve.

5 Claims, 2 Drawing Sheets

HYDRAULIC SYSTEM

BACKGROUND OF THE INVENTION

The invention concerns a hydraulic system with a pressure source controllable via a load sensing signal, a pressure sink, at least two working sections, each having a hydraulic consumer and a control valve with a load sensing connection, and at least one back-pressure valve arranged in a tank pipe between the control valve and the pressure sink.

Such a system is known from DE 42 35 762 C2.

In this case, the pressure source can be a pump with controllable discharge capacity. However, it is also possible to provide a pump followed by a pressure control valve.

In many cases a proportional valve is used as control valve. In the neutral position of this valve the load sensing signal connection is connected with the tank pipe. The load sensing signal can also be called load pressure signal. The load sensing signal connections of all working sections are connected with each other via shuttle valves in a way that the load sensing signal with the highest pressure reaches the controllable pressure source. Thus the pressure source can produce the required pressure corresponding to the load sensing signal, also called LS-signal. The fact that the load sensing signal connection is connected with the tank pipe in the neutral position of the control valve should secure that without a consumption from a consumer the pump does not produce a higher pressure. When the control valve is in its neutral position, the hydraulic consumer connected with the control valve, i.e. a motor or a piston-cylinder unit, is not influenced and accordingly it needs no hydraulic output.

However, a certain problem occurs because of the back-pressure valve. When a hydraulic consumer, e.g. a piston-cylinder arrangement with two working chambers, is loaded by an external force leading to a displacement of the piston of this piston-cylinder unit, one working chamber must be expanded, the other must be reduced. This is for instance the case with front-end loaders, the loaded shovel of which must be lowered. In the expanding working chamber there is a relatively low pressure, e.g. 0 bar. To avoid cavitation damages, additional hydraulic fluid should be supplied at a correspondingly low pressure. However, this additional supply should not lead to an increase of the force acting on the piston. The additional supply takes place through a refill valve arranged between the two working chambers of the consumer. To overcome the closing force of this refill valve, it is necessary that a certain pressure builds up on the corresponding side. The building-up of this pressure is secured through the back-pressure valve. The back-pressure, i.e. the pressure before the back-pressure valve, is in such cases normally fairly close to a load sensing pressure, thus corresponding to the load sensing signal. Due to the pressure drop over the refill valve, certain differences will, however, occur. This causes that the load sensing pressure on this consumer is normally lower than the back-pressure. As the higher pressure is always regarded as load sensing pressure, the back-pressure will be reported back to the pump control. This leads to an increase of the pump pressure. This again affects the back-pressure, which becomes smaller. When the back-pressure becomes smaller, the load sensing signal reassumes the control of the pump. Hereby the pump pressure becomes lower and the back-pressure becomes higher, leading to the initially described situation. There is a risk that the system starts oscillating and unstable conditions occur.

SUMMARY OF THE INVENTION

The task of the invention is to avoid such a situation.

According to the invention, this task is solved in that in a hydraulic system as described in the introduction the load sensing signal connection in the neutral position of the control valve is connected to the pressure sink via an auxiliary tank pipe by-passing the back-pressure valve.

Thus the load sensing signal of a control valve in the neutral position always has the lowest value. Undesired pressure increases of the load sensing signal are avoided, as a pressure increase before the back-pressure valve can no longer affect the load sensing signal. Thus the desired effect is reached: The pressure source receives a signal saying that the consumer, the control valve of which is in the neutral position, has no pressure demand. On the occurrence of external forces on another hydraulic consumer, however, this hydraulic consumer can be controlled so that the refilling of its working chamber is under control, to avoid cavitation damages. In this connection the back-pressure valve secures that hydraulic fluid displaced from another working chamber does not immediately flow back to the tank, but is led to the first working chamber again. However, as mentioned, an influencing of the load sensing signal is not involved in this. The fitting of an additional pipe, namely the auxiliary tank pipe, is relatively simple. As practically only pressures must be passed on in this auxiliary tank pipe, without requirement for large transports of fluids, the dimensions of this pipe can be kept correspondingly small.

Preferably, the auxiliary tank pipe has a non-return valve closing towards the control valve. This secures that possibly occurring pressure oscillations of the pressure sink will not influence the load sensing signal system or a possible electrical activation of the control valves. In this connection it should be noted that the pressure sink is not absolutely kept at a pressure of 0 bar or atmospheric pressure. In some cases pressures of for example 2 to 6 bar can prevail. In case of cold hydraulic fluid there may be a temperature dependence, by which the pressure can be about 10 bar. However, such an influence is kept away from the load sensing signal connection by the non-return valve in the auxiliary tank pipe.

Alternatively or additionally, the auxiliary tank pipe in a preferred embodiment may comprise its own pressure sink connection, which is separated from that of the back-pressure valve. Thus, pressure fluctuations, which may occur on the outlet of the back-pressure valve under adverse conditions, can no longer be transferred to the auxiliary tank pipe. When the auxiliary tank pipe has its own pressure sink connection, the non-return valve is no longer required in all cases.

It is especially advantageous to arrange the control valve in a valve block having a through-going auxiliary tank pipe next to the through-going tank pipe. Normally, several valve blocks are arranged next to each other and flanged together side by side, by which the corresponding pipes pass through all valve blocks. This is especially the case with the pressure pipe, which is often also called pump pipe, the tank pipe, the load sensing pipe and, as in this case, the auxiliary tank pipe. In this case one single back-pressure valve will be sufficient, however, it is secured that a pressure build-up before the back-pressure valve can no longer influence the load sensing signal.

Preferably, a refill valve arrangement is provided between the tank pipe and the consumer. This refill valve arrangement enables the decanting of hydraulic fluid from one working chamber of the hydraulic consumer to the other on the occurrence of external forces. In this connection, the back-pressure valve secures, however, that this hydraulic fluid is not flowing back to the tank.

BRIEF DESCRIPTION OF THE DRAWINGS

In the following the invention is described on the basis of preferred embodiments in connection with the drawings, showing.

DESCRIPTION OF EXAMPLES EMBODYING THE BEST MODE OF THE INVENTION

Figure 1:
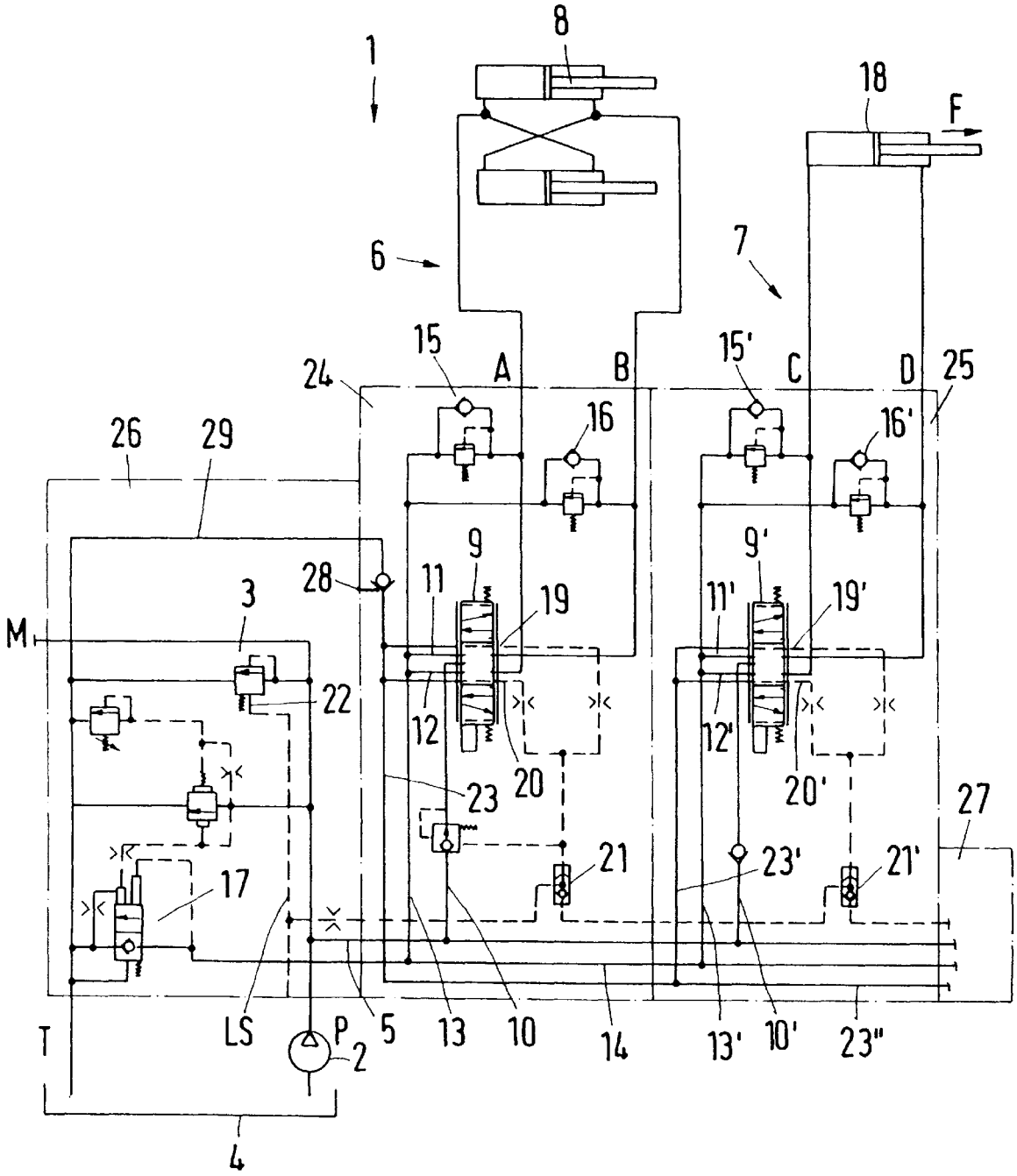
FIG. 1 a first embodiment of a hydraulic system.

A hydraulic system 1 has a controlled pressure source, consisting of a pump 2 and a pressure control valve 3 arranged after the pump. The pump 2 takes hydraulic fluid from a tank 4 and supplies it via a pump pipe 5, branching between the pump 2 and the pressure control valve 3, into at least two working sections 6, 7.

The working section 6 has a hydraulic consumer 8, in this case a steering motor. The hydraulic consumer 8 is connected with the working connections of a proportional valve 9.

Via a pump branch pipe the proportional valve 9 is connected with the pump pipe 5. Further, the proportional valve has two tank connections 11, 12, which are connected with a tank pipe 14 via a tank branch pipe 13. Between the tank branch pipe 13 and each working connection A, B of the proportional valve 9 a refill valve 15, 16 is arranged.

The proportional valve 9 has two load sensing signal connections 19, 20. When the proportional valve 9 is not in the neutral position, but is supplying hydraulic fluid to the consumer 8, one of the load sensing signal connections 19, 20 is connected with the working connection A, B, which is connected with the pump connection 10. Then this pressure is passed on to a load sensing signal pipe (LS-pipe) via a change-over valve 21, which always passes on the higher of the pressures on its inputs, the LS-pipe being connected with a control input of the pressure control valve 3. Thus it is possible always to control the pressure in the pump pipe 5 in dependence of the required pressure.

In the neutral position the two load sensing signal connections 19, 20 are connected with an auxiliary tank pipe 23.

Apart from having a different consumer, 18, the working section 7 has exactly the same embodiment. The parts corresponding to those of the working section 6 are therefore provided with crossed out reference numbers. Thus the working connections A, B of the working section 6 correspond to the working connections C, D of the working section 7.

The tank pipe 14 extending through all working sections 6, 7, is connected with an inlet of a back-pressure valve 17, the outlet of which is connected with a tank connection T.

The working section 6 has a valve block 24. The working section 7 has a valve block 25. A supply block 26 is flanged onto the valve block 24. The valve block 24 is flanged together with the valve block 25 and an end block 27 is flanged onto the other end of the valve block 25. Of course more than two working section 6, 7 can be provided. The valve blocks 24, 25, the supply block 26 and the end block 27 are only to be understood as functional here. Of course, all blocks can also be placed in a common housing, resulting in a monoblock. Thus, the valves of several working sections can be placed in the same block. Naturally, this procedure also permits more such monoblocks to be connected, e.g. two such monoblocks, each with four valves (corresponding to four working sections), could be built together to one section with eight valves.

The auxiliary tank pipe 23 is led through the supply block 26 with a pipe section 29. Thus it bypasses the back-pressure valve 17, i.e. it flows into tank 4 together with the outlet of the back-pressure valve 17.

To keep interferences, which might occur on the outlet of the back-pressure valve 17, away from the auxiliary tank pipe 23, a non-return valve 28 is arranged in the pipe section 29 of the auxiliary tank pipe 23 to the tank T. This non-return valve 28 opens in the direction of the supply block 26. It can also be arranged in the supply block 26.

When, e.g., the hydraulic consumer 18, made as a piston-cylinder-unit, is loaded by an external force F, by which the piston in the drawing should be displaced to the right, the pressure on working connection D increases and the pressure on working connection C decreases. When now the proportional valve opens correspondingly, hydraulic fluid flows through the working connection D and the tank connection 11' to the tank pipe 14. Due to the back-pressure valve 17 a pressure arises here, which will finally be high enough to open the refill valve 15'. Thus the hydraulic fluid displaced from the working chamber connected with the working connection D can flow into the other working chamber of the consumer 18 via the working connection C. However, there will be no simultaneous pressure increase on the load sensing signal connection 19' or 20'. As there is no connection between the tank pipe 14 and the load sensing connection 19, 20 on the proportional valve 9 of the first working section 6, there will not be any influence on the load sensing signal here either. Correspondingly, the pressure source 2, 3 are not activated, i.e. its pressure is not increased with this embodiment. The refill of the consumer 18 can take place at a correspondingly low pressure.

As usual, the pump pipe 5 and the tank pipe 14 are made through-going for all valve blocks 24, 25 arranged next to each other. In this case, the auxiliary tank pipe 23, 23' of the two valve blocks 24, 25 flow into an auxiliary tank pipe 23", which is also made through-going for all valve blocks 24, 25, i.e. for all working sections 6, 7.

For reasons of clearness, the transition between the left valve block 24 and the supply block 26 is made so that the auxiliary tank pipe 23" is not going direct through the supply block 26, but is connected with the tank T via a pipe 29 provided in the supply block 26. However, it is of course also possible to let the auxiliary tank pipe 23" go right through the supply block 26.

Figure 2:
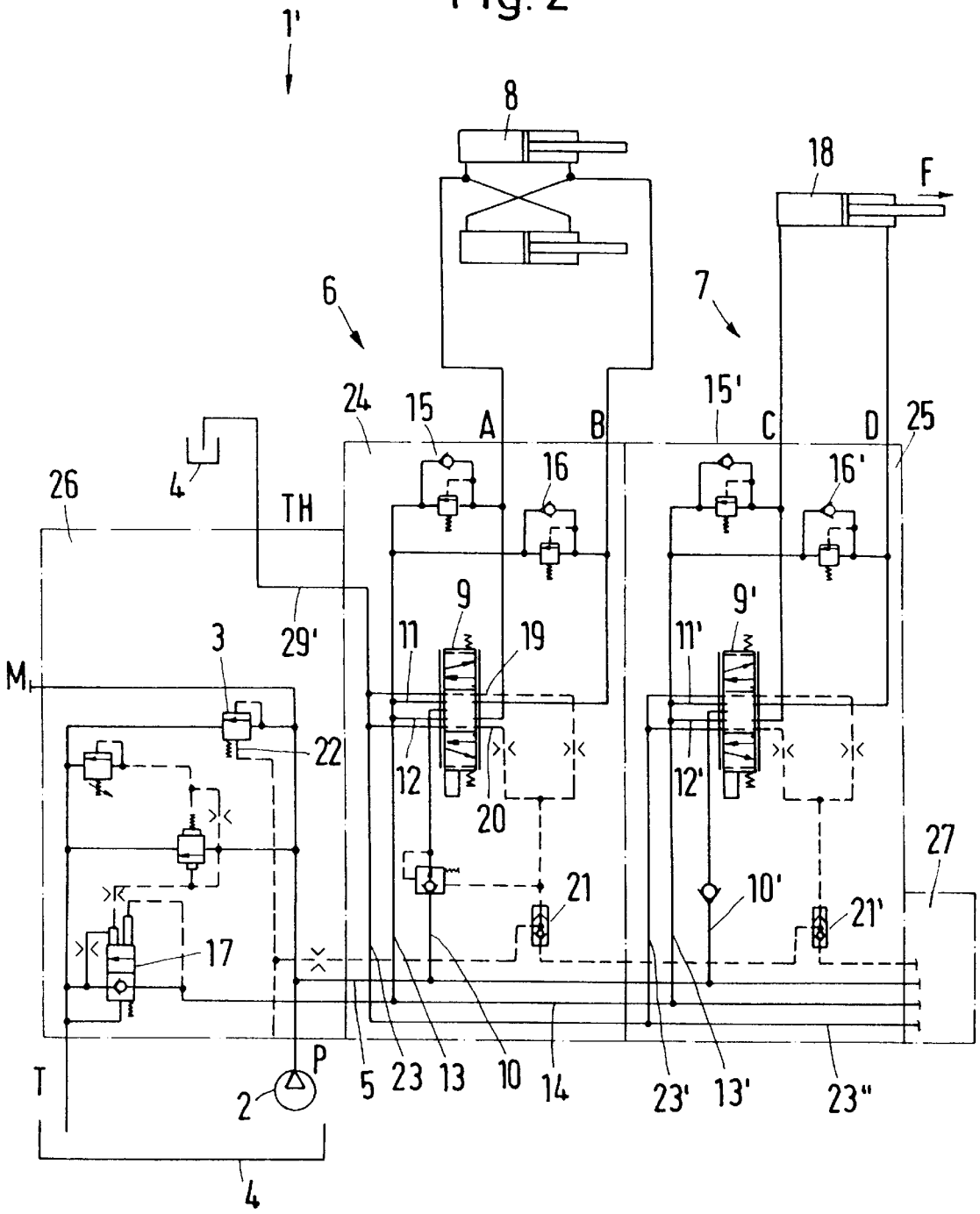
FIG. 2 a second embodiment of a hydraulic system.

FIG. 2 shows a modified embodiment of the hydraulic system 1'. The same parts have the same reference numbers.

What has been changed, however, is that the pipe 29' is no longer led to the outlet of the back-pressure valve 17. On the contrary, it is led into the tank 4 via an auxiliary tank connection TH, i.e. has a separate tank connection. With this embodiment the non-return valve 28 can be spared. However, it can also be provided as an additional feature.

The embodiment, in which the auxiliary tank pipe 29' is no longer led to the outlet T involves the advantage, that here a real disconnection between the back-pressure valve 17 and the load sensing signal takes place. Normally, it takes a considerable effort to make non-return valves tight. However, as long as some fluid can pass the non-return valve 28, the influence on the load sensing signal cannot be prevented. The embodiment according to FIG. 2, however, involves the advantage that using a pump with constant displacement output will give energy savings when idling, as this embodiment completely prevents a pressure from being built up in the load sensing signal system.

We claim:

1. Hydraulic system with a pressure source controllable via a load sensing signal, a pressure sink, at least two working sections, each having a hydraulic consumer and a control valve with a load sensing signal, and at least one back-pressure valve arranged in a tank pipe between the control valve and the pressure sink, the load sensing signal in a neutral position of the control valve being connected to the pressure sink via an auxiliary tank pipe by-passing the back-pressure valve.

2. System according to claim 1, in which the auxiliary tank pipe has a non-return valve closing towards the control valve.

3. System according to claim 1, in which the auxiliary tank pipe has its own pressure sink connection, which is separate from that of the back-pressure valve.

4. System according to claim 1, in which the control valve is arranged in a valve block having the auxiliary tank pipe next to the tank pipe.

5. System according to claim 1, in which a refill valve arrangement is provided between the tank pipe and a hydraulic consumer.

* * * * *